United States Patent [19]

Davis

[11] 4,031,831

[45] June 28, 1977

[54] TABLE FURNITURE

[76] Inventor: Pauline Dortch Davis, 42 Redwood Road, Severna Park, Md. 21146

[22] Filed: Aug. 27, 1975

[21] Appl. No.: 608,064

[52] U.S. Cl. ..... 108/159

[51] Int. Cl.[2] ..... A47B 3/06

[58] Field of Search ..... 52/81, 648, 639; 108/150, 159; D6/36, 146, 175, 177, 196, 194

[56] References Cited

UNITED STATES PATENTS

| | | | |
|---|---|---|---|
| 1,613,788 | 1/1927 | Dawson et al. | 52/648 |
| 2,265,841 | 12/1941 | Jankowski | 297/462 X |
| 3,104,454 | 9/1963 | Handley et al. | 52/648 X |
| 3,830,031 | 8/1974 | Soisson | 52/648 |
| D. 159,562 | 8/1950 | Tanier | D6/177 |
| D. 169,868 | 6/1953 | Schwartz | D6/175 |
| D. 233,108 | 10/1974 | Rosen | D6/175 |

OTHER PUBLICATIONS

Life Magazine, Dec. 7, 1959, p. 86.

*Primary Examiner*—James T. McCall

[57] ABSTRACT

A novel table base is provided as an article of manufacture for furniture. It is intended for use either as a table or as a hassock (with cushion) or as a stool (without cushion). The base support consists entirely of an even number of triangles alternately disposed around a closed figure and lying between two horizontal planes.

7 Claims, 7 Drawing Figures

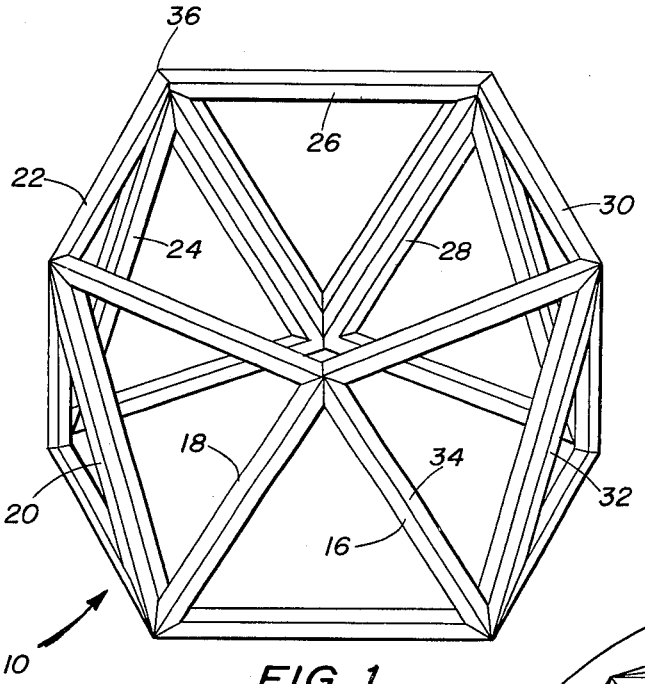
FIG. 1
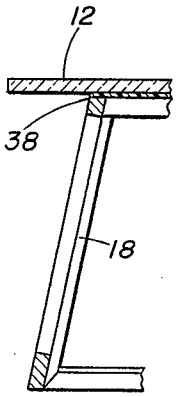
FIG. 6
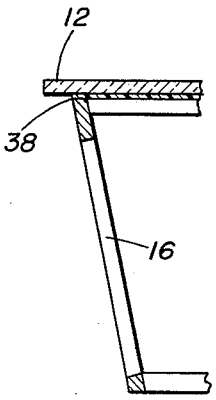
FIG. 5
FIG. 2
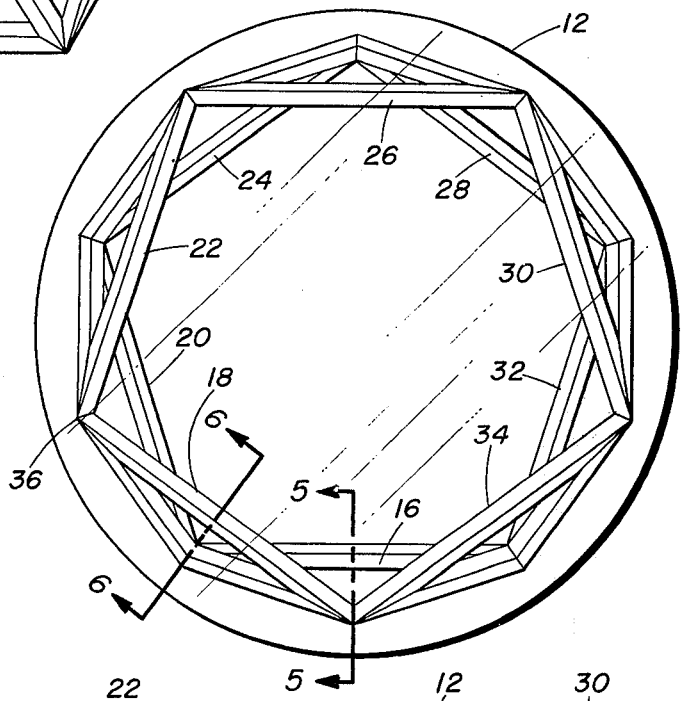
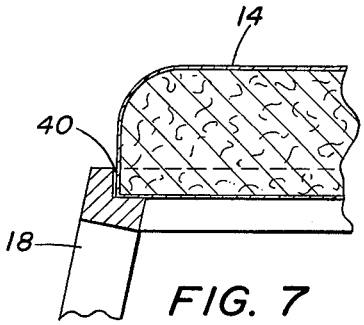
FIG. 7
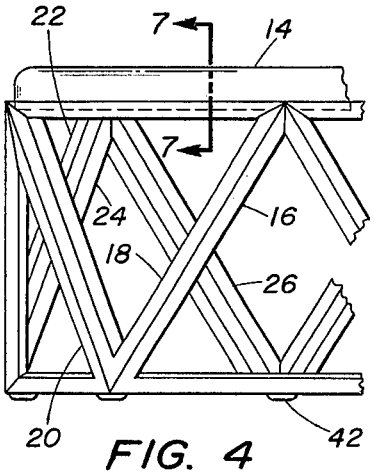
FIG. 4
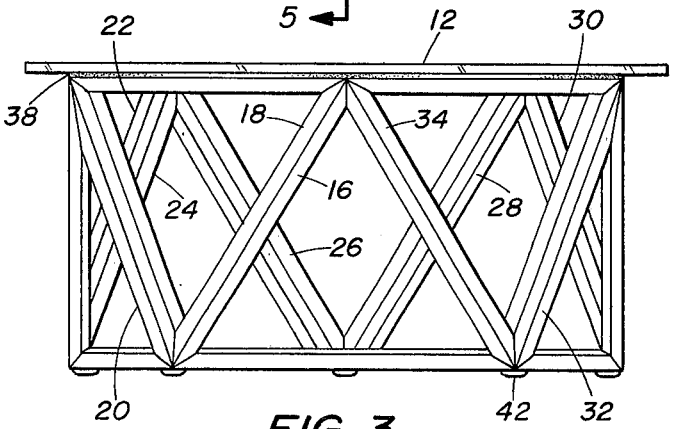
FIG. 3

TABLE FURNITURE

BACKGROUND OF THE INVENTION

This invention relates generally to furniture, and more particularly to a new type of table base for supporting a top, which can be either transparent or opaque. Whereas most straight line furniture, especially tables, have their support based on ninety degree joinery, this table has support based on interlocking, alternately pointing and tilting triangles. The result is a structure whose appearance is different from existing furniture, yet this structure is aesthetically pleasing because of the classic simplicity of its form.

SUMMARY OF THE INVENTION

It is an object of this invention, therefore, to provide table furniture whose design has visual simplicity yet great structual strength.

Another object of this invention is to provide table furniture or the like which is economical to manufacture, and easy to use and maintain.

Still another object of this invention is to provide a design of table furniture whose structure consists entirely of a closed plurality of adjacent or contiguous triangles.

BRIEF DESCRIPTION OF DRAWINGS

Other objects and attendant advantages of this invention will become more readily apparent and understood from the following detailed specification and accompanying drawings in which:

FIG. 1 is a perspective view of one embodiment of table furniture incorporating features of the invention;

FIG. 2 is a plan view of the base of the table furniture of FIG. 1 with a transparent table top attached;

FIG. 3 is a side elevation of the table furniture of FIGS. 1 and 2;

FIG. 4 is a partial elevation view of the table furniture of FIG. 1 modified for a cushion top;

FIG. 5 is a section view taken along line 5—5 of FIG. 2;

FIG. 6 is a section view taken along 6—6 ofFIG. 2; and FIG. 7 is a section taken along line 7—7 of FIG. 4.

DETAILED DESCRIPTION

Referring now to FIGS. 1, 2, 3, 5, and 6, there is shown a piece of table furniture 10 having a transparent table top 12. If desired, the transparent table top can be made of any desirable material and, if necessity dictates, if can be formed opaque.

The table furniture or support 10 is formed of a plurality of ten (10) equilateral triangles 16, 18, 20, 22, 24, 26, 28, 30, 32, and 34. The design of the furniture 10 consists ten (10) adjacent equilateral triangles around the mid-section of a regular icosahedron which is a twenty sided solid figure.

The framework for the table furniture 10, that is, the truss members can be of any desired cross section, as they come together at their ends so as to form equilateral triangles 18, 20, 22, 24, 26, 28, 30, 32, and 34. These can be replaced by isosceles triangles. This is the same basic structure of table furniture 10, except that isosceles triangles become the basic component. By changing the dimensions of the triangles, the size of the article of furniture can be adjusted. Such variations are highly desirable and useful.

The triangular members are of identical size and shape as shown in the embodiment of FIGS. 1, 2, 3, 5 and 6. The locus of the points of the triangles lie on a circle as shown in FIG. 2. As best shown in FIG. 2 triangles 16, 18, 20, 22, 24, 26, 28, 30, 32 and 34 extend upwardly and downwardly and are alternately inclined inwardly and outwardly.

As shown best in FIG. 3, the edges of the truss members forming the equilateral triangles are beveled which is typical for forming all joints. As best illustrated in FIG. 3 slider buttons 42 can be secured to the bottom of the table furniture 10 to allow it to be readily moved. A non-slip gasket 38 is provided around the periphery of the table furniture 10 for the table top 12.

Referring now to FIGS. 4 and 7 of the drawings there is shown a modified table furniture, which has a cutout provided around periphery of the table furniture 10 to receive a cushion top 14 or the like, so as convert the table 10 into a hassock. Of course, the height of the equilateral triangles 16 to 34 would be reduced.

The table structure 10 or variations thereof can be formed to have the equilateral (or isosceles) triangles opened, closed, transparent, and of any desirable construction material, including free-form molding.

Obviously many modifications and variations of the present invention are possible in light of the above teachings. It is, therefore, to be understood that within the scope of the appended claims the inventioned may be practiced otherwise than as specifically described.

What is claimed is:

1. As an article of manufacture, a furniture structure comprising a base for supporting a horizontally disposed member in spaced relation to a floor, said base consisting only a plurality of triangles of identical size and shape, said triangles alternately extending upwardly and downwardly and being alternately inclined inwardly and outwardly with the locus of the points of said triangles lying on a circle, said triangles having a plurality of sides extending towards and supporting said horizontally disposed member.

2. As an article of manufacture as recited in claim 1, wherein the triangular sides are equilateral.

3. As an article of manufacture as recited in claim 1, wherein the triangular sides are isosceles.

4. As an article of manufacture as recited in claim 1, wherein the triangular sides are open and the top and bottom are also open.

5. As an article of manufacture as recited in claim 1, wherein the triangular sides and top and bottom are closed.

6. As an article of manufacture as recited in claim 1, means provided on the bottom of said support base to facilitate the movement thereof.

7. As an article of manufacture as recited in claim 1, the number of sides being ten and of equilateral shape.

* * * * *